US006182481B1

(12) United States Patent
Nagy

(10) Patent No.: US 6,182,481 B1
(45) Date of Patent: Feb. 6, 2001

(54) SECURITY LOCK FOR LAPTOP AND NOTEBOOK COMPUTERS

(76) Inventor: Neil Frank Nagy, 414 W. Sixth St., San Pedro, CA (US) 90731

( * ) Notice: Under 35 U.S.C. 154(b), the term of this patent shall be extended for 0 days.

(21) Appl. No.: 09/426,245

(22) Filed: Oct. 25, 1999

Related U.S. Application Data

(60) Provisional application No. 60/105,777, filed on Oct. 27, 1998.

(51) Int. Cl.[7] ..... E05B 69/00

(52) U.S. Cl. ..... 70/58; 70/14; 248/551

(58) Field of Search ..... 70/14, 18, 19, 70/57, 58, 63, 158–162; 248/551–553; 361/681, 685, 686, 732

(56) References Cited

U.S. PATENT DOCUMENTS

| | | | | |
|---|---|---|---|---|
| 153,673 | * | 8/1874 | Fox | 70/57 |
| 1,707,225 | * | 4/1929 | Jackson | 70/57 X |
| 4,313,319 | * | 2/1982 | Haus, Jr. et al. | 70/34 |
| 4,359,646 | * | 11/1982 | Mejia et al. | 248/551 X |
| 4,924,683 | * | 5/1990 | Derman | 70/58 X |
| 5,351,508 | * | 10/1994 | Kelley | 70/58 |
| 5,406,809 | * | 4/1995 | Igelmund | 70/18 X |
| 5,447,045 | * | 9/1995 | Cheng | 70/58 |
| 5,450,271 | * | 9/1995 | Fukushima et al. | 70/58 X |
| 5,526,226 | * | 6/1996 | Katoh et al. | 70/159 X |
| 5,594,419 | * | 1/1997 | Lo | 248/551 X |
| 5,595,074 | * | 1/1997 | Munro | 70/58 |
| 5,709,110 | * | 1/1998 | Greenfield et al. | 70/58 |
| 5,757,616 | * | 5/1998 | May et al. | 70/58 X |
| 5,787,738 | * | 8/1998 | Brandt et al. | 70/18 X |
| 5,819,561 | * | 10/1998 | Blehi, III | 70/34 X |
| 5,870,281 | * | 2/1999 | Kim | 70/58 X |
| 5,960,651 | * | 10/1999 | Tanisawa | 70/14 |
| 5,987,937 | * | 11/1999 | Lee | 70/18 X |
| 6,000,252 | * | 12/1999 | Murray, Jr. et al. | 70/58 |

FOREIGN PATENT DOCUMENTS

| | | | | |
|---|---|---|---|---|
| 2635555 | * | 2/1990 | (FR) | 70/58 |
| 2160253 | * | 12/1985 | (GB) | 70/58 |

* cited by examiner

*Primary Examiner*—Suzanne Dino Barrett
(74) *Attorney, Agent, or Firm*—Mark Krietzman

(57) ABSTRACT

A novel security lock for laptop and notebook computers which prohibits the separation of the monitor from the keyboard, may provide an audible motion sensitive alarm and a secondary anchor cable.

21 Claims, 2 Drawing Sheets

SECURITY LOCK FOR LAPTOP AND NOTEBOOK COMPUTERS

RELATED APPLICATIONS

The within invention claims the benefit under Title 35, United States Code § 119 (e) of Provisional Application 60/105,777 entitled "Security Lock For Laptop and Notebook Computers", filed Oct. 27, 1998.

BACKGROUND OF THE INVENTION

1. Field of the Invention

This present invention relates to a novel security lock for notebook or laptop computers, and more specifically to a security lock which seals shut a laptop or notebook computer, may also anchor the laptop computer to a stationary base and which may act as a transportation handle.

2. Background

Notebook computers are easily tampered with, data may be accessed without authorization and corrupted or stolen. A security lock is therefore needed which will secure, via a mechanical seal, a wide variety of different size notebook and laptop computers and which may also anchor and prevent the removal of the computer.

Prior art computer security locks, teach mounting anchors some easily attached to various laptop configurations others narrowly specific to the type of lap top the will engage with.

In U.S. Pat. No. 5,351,508, by Kelley, a combination handle and anchor for a cable locking system is taught, which will replace extended feet formed as part of a particular computer model and can form a mounting anchor for a cable lock. Not taught or envisioned is a lock which prevents the opening of the laptop and thereby keeps the machine turned off and data secure.

In U.S. Pat. No. 5,787,738 issued to Brandt, a small locking plate with a catching end and a free end may be extended between the keyboard and monitor of a laptop computer and a cable lock affixed to the free end. Such a lock catches the bottom edge of the monitor and may damage the monitor and does not prevent unauthorized access to the computers data.

Prior art does not provide a simple device for securing the data within the laptop computer, by prohibiting the opening of the laptop computer, nor does prior art provide a combination security lock which seals the notebook computer shut and an anchor mount to affix the laptop in an open or sealed position to a stationary object.

SUMMARY OF INVENTION

Accordingly, it is an object of the invention to provide a novel security lock for notebook computers.

It is yet another object of the invention to provide a novel security lock which maintains the closure of a notebook computer.

It is yet another object of the invention to provide a novel security lock which maintains the closure of a notebook computer and provides for a secondary anchor mount for a lock to a stationary object.

It is yet another object of the invention to provide a novel security lock which maintains the closure of a notebook computer and provides for a secondary anchor mount for a lock to a stationary object and a carrying handle.

It is yet another object of the invention to provide a novel security lock which maintains the closure of a notebook computer and provides a motion sensing alarm.

It is yet another object of the invention to provide a novel security lock which maintains the closure of a notebook computer and provides a motion sensing alarm and a carrying handle.

The features of the invention believed to be novel are set forth with particularity in the appended claim. The invention itself, however, both as to configuration, and method of operation, and the advantages thereof, may be best understood by reference to the following descriptions taken in conjunction with the accompanying drawings.

MODES FOR CARRYING OUT THE INVENTION

Figure 1A:
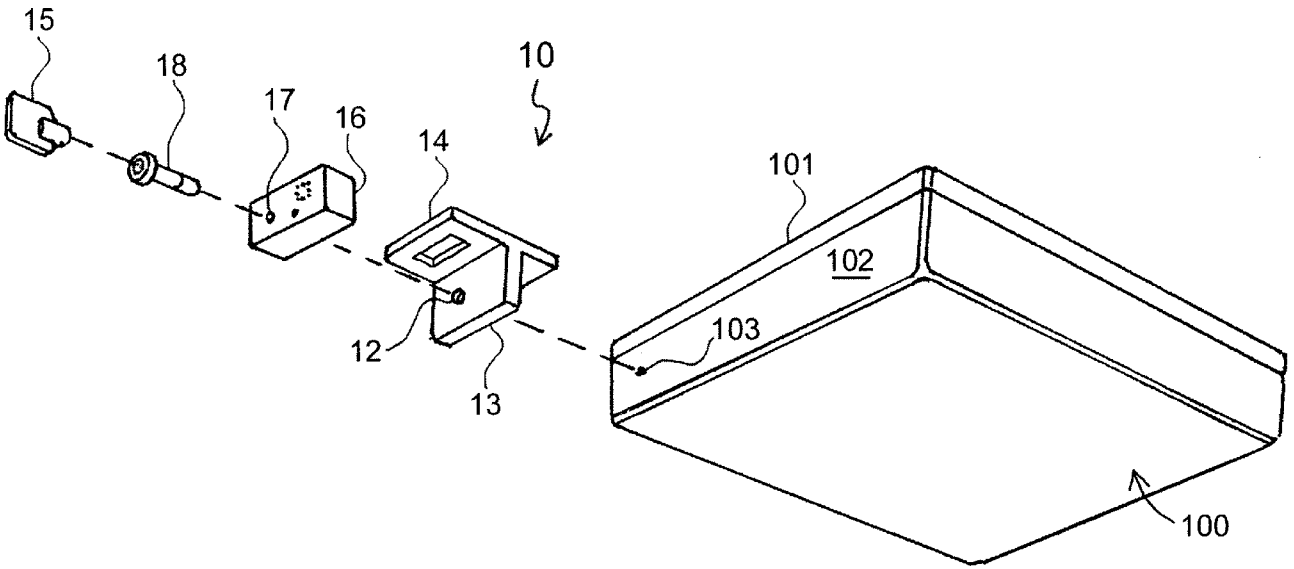
FIG. 1A illustrates a perspective assembly view of the preferred embodiment of the security lock for notebook computers.

Referring now to FIG. 1A there is illustrated a perspective assembly view of alternate embodiments of the security lock for notebook computers, generally designated 10.

The notebook computer 100 has a monitor 101 and a CPU/keyboard 102 if kept in the closed position the use of the notebook computer 100 is prevented. A body lock catch 103 formed as part of, or cut into, the CPU/keyboard 102 portion of the notebook computer case, is of a size and shape to allow insertion of a cylindrical body lock 18, such locking mechanisms are well known in the art therefore a detailed description of its construction has not been included. Such a lock generally comprises a keyed entry, a latching member and a positioning guide.

The cylindrical body lock 18 passes into the reversible lock catch 12 formed as part of the "T" shaped cover latch 13 and mates with the body lock catch 103 affixing the security lock 10 to the notebook computer 100. When the "T" shaped cover latch 13 is positioned over the monitor 101 it will prevent the monitor 101 from being raised from the CPU/keyboard 102.

For convenience one "side of T" shaped cover latch 13 has a hand guide 14 which forms a handle for carrying. To attach the "T" shaped cover latch 13 to the notebook computer 100, a user passes the cylindrical body lock 18 into through the reversible lock catch 12 to the body lock catch 103 and a key 15 is turned to actuate the locking mechanism.

An alarm box 16 which houses a battery operated motion sensing switch with audible alarm, which is known art therefore a detailed description of its construction is not included, may be added to, or integrated into, the device. Through the alarm box 16 an alarm lock catch 17 is formed through which the cylindrical body lock 18 may pass through and then through the reversible lock catch 12 to mate with the body lock catch 103, thereby affixing the security lock 10 and alarm box 16 to the notebook computer 100. Not shown is an "on/off" switch or access cover on the rear alarm box 16 adjacent to the reversible lock catch 12. A keyed mechanical switch is contemplated with a rotating switching arm and a pressure switch.

Figure 1B:
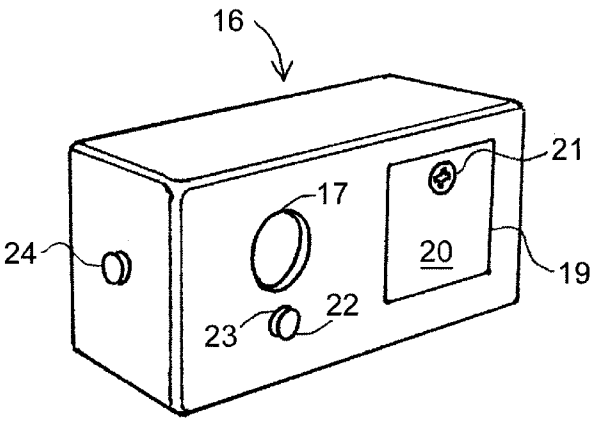
FIG. 1B illustrates a perspective rear view of the alarm box for the security lock for notebook computers.

Referring now to FIG. 1B there is illustrated a perspective rear view of the alarm box for the security lock for notebook computers generally designated 16. A access window 19 formed on the rear of the alarm box 16, has a plate cover 20 with a mounting screw 21, whereby the battery supply may be changed as needed. A "on/off" pressure switch 22 extending through the back of the alarm box 16, via a switch guide 23, when closed, activates the electrical circuit and supplies power to both the alarm and a red LED 24, which is conductively connected to the alarm circuit. To disarm the alarm, the user simply removes the cylindrical body lock (not shown) and slides the alarm box 12 forward to disengage the pressure switch.

Figure 1C:
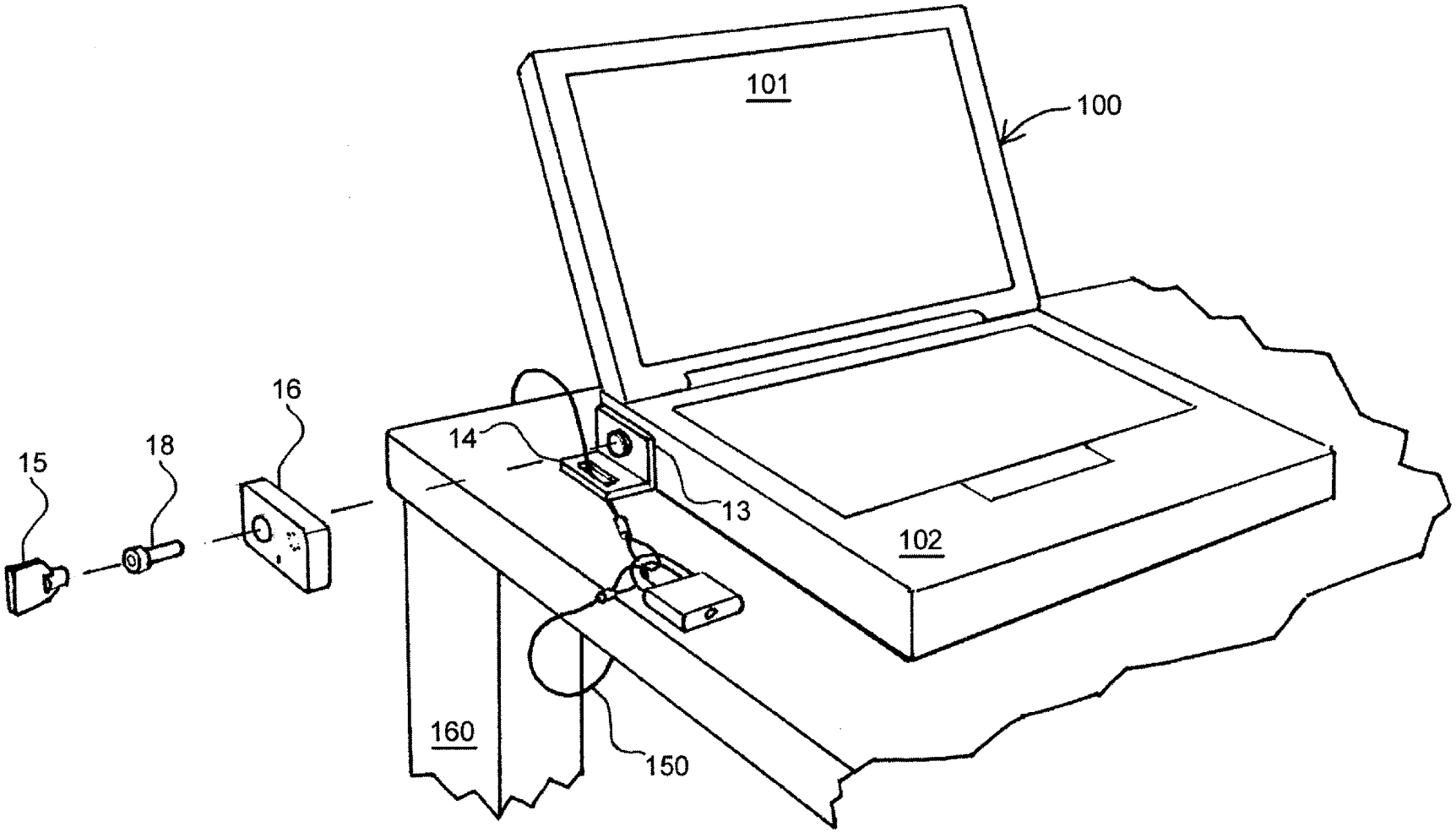
FIG. 1C illustrates a perspective assembly view of the embodiment of FIG. 1A anchoring an open laptop.

Referring now to FIG. 1C there is illustrated a perspective assembly view of the embodiment of FIG. 1A, generally designated 10, anchoring an open notebook computer 100. By reversing the mount of the "T" shaped cover latch 13 so that it rests under the CPU/monitor 102, the hand guide 14 may be used to anchor a cable lock 150 to both the security lock 10 and a stationary object 160.

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A security lock system for laptop and notebook computers comprising:

(a) a rigid "T" shaped plate with a lock guide;

(b) a lock catch formed within the CPU-keyboard portion of a laptop or notebook computer;

(c) a box shaped hollow alarm module with a front and back wall, whereby said back wall fits against said rigid "T" shaped plate;

(d) a lock guide, of a pre-determined shape and orientation traversing from said back wall to said front wall of said box shaped hollow alarm module;

(e) a long lock with an enlarged head end of a diameter in excess of said lock guide and a smaller tail of a diameter less than said lock guide;

(f) a body latch affixed to said smaller tail and of a size and shape to removably mate with said lock catch;

(g) a battery powered audible alarm with a motion sensing switch affixed within said hollow alarm module;

(h) a series of batteries supplying electrical current to said audible alarm affixed within said hollow alarm module;

(i) a red LED affixed to the exterior of said hollow alarm module and electrically connected to said audible alarm to indicate said audible alarm is active;

(j) an on/off switching means, whereby electrical current is supplied to said battery powered alarm with motion sensing switch;

(k) a removable access panel, formed on the rear wall of said alarm module, to adjust said audible alarm and replace said batteries as needed; and, (l) a key means for reversible latching and unlatching said body latch to said lock catch, whereby the placement of of said long lock through said "T" shaped plate and the latching of said body latch into said lock catch prohibits the raising of the monitor portion of a laptop or notebook computer.

2. The security lock system for laptop and notebook computers according to claim 1, wherein said key means is a key guide formed on said enlarged head and an insertable key.

3. The security lock system for laptop and notebook computers according to claim 1, further comprising:

(a) a mounting guide for a cable; and, (b) a cable with a first end affixed to said mounting guide and a looped second end, whereby said looped second end may be wrapped around a stationary object and then said rigid "T" shaped plate may be inserted through said looped second then locked to a computer, thereby locking a computer to a stationary object with said cable.

4. The security lock system for laptop and notebook computers according to claim 1, further comprising a carrying handle formed as part of, or affixed to said rigid "L" shaped corner plate.

5. The security lock system for laptop and notebook computers according to claim 4, further comprising:

(a) a cable with looped first and second ends; and (b) a padlock whereby one of said looped ends may be inserted through said carrying handle and then wrapped around a stationary object and said padlock may by locked through said looped ends, thereby anchoring the security lock.

6. The security lock system for laptop and notebook computers according to claim 1, further comprising an extended body plate affixed to, or formed as part of, said "T" shaped plate and adapted to fit over a portion of a removable modular component access bay, whereby when said "T" shaped plate is affixed to a computer said access bay is blocked and a device such as a battery supply, hardrive, CD-ROM drive, or Zip drive vented from being removed.

7. The security lock system for laptop and notebook computers according to claim 1, further comprising an extended body plate affixed to, or formed as part of, said "T" shaped plate and adapted to fit over a portion of an access door for a floppy disk, removable media, or CD drive, whereby when said "T" shaped plate is affixed to a computer said access door is blocked.

8. The security lock system for laptop and notebook computers according to claim 4, further comprising:

(a) a cable with first and second ends; and, (b) a combination lock attached to said first end with a latching catch formed on said second end whereby one of said ends may be inserted through said carrying handle and then wrapped around a stationary object and then said latching catch may be inserted into said combination lock, thereby anchoring the security lock and all that it is attached to.

9. The security lock system for laptop and notebook computers according to claim 1, wherein said on/off switching means is a button switch extending from the rear wall of said hollow alarm module whereby insertion of said button switch, during mounting of said alarm module against said rigid "T" shaped plate causes the electrical current to be supplied to said battery powered alarm with motion sensing switch.

10. The security lock system for laptop and notebook computers according to claim 1, wherein said on/off switching means is a mechanical lock cylinder and a key whereby the action of said key rotated within said lock cylinder causes a switching arm to actuate a contact switch means whereby electrical current is supplied to said battery powered alarm with motion sensing switch.

11. The security lock system for laptop and notebook computers according to claim 10, wherein said contact switch means is selected from the group of electrical switches including push switches, single contact switches, click on/click off switches, optical switches, and pressure switches.

12. A security lock system for laptop and notebook computers comprising:

(a) a lock catch formed within the CPU-keyboard portion of a laptop or notebook computer;

(b) a box shaped hollow alarm module with front and back wall and a top and bottom face;

(c) a rigid lock plate extending beyond one or more edges of said top face of said alarm module adapted to fit over the closed monitor display of a laptop or notebook computer;

(d) a lock guide, of a pre-determined shape and orientation, traversing from said back wall to said front wall of said box shaped hollow alarm module;

(e) a long lock with an enlarged head end of a diameter in excess of said lock guide and a smaller tail of a diameter less than said lock guide;

(f) a body latch affixed to said smaller tail and of a size and shape to removably mate with said lock catch;

(g) a battery powered audible alarm with a motion sensing switch affixed within said hollow alarm module;

(h) a series of batteries supplying electrical current to said audible alarm affixed within said hollow alarm module;

(i) a LED affixed to the exterior of said hollow alarm module and electrically connected to said audible alarm to indicate said audible alarm is active;

(j) an on/off switching means, whereby electrical current is supplied to said battery powered alarm with motion sensing switch;

(k) a removable access panel, formed on the rear wall of said alarm module, to adjust said audible alarm and replace said batteries as needed; and, (l) a key means for reversible latching and unlatching said body latch to said lock catch, whereby the placement of said long lock through said lock guide and the latching of said body latch into said lock catch positions said rigid lock plate against the closed monitor display of a laptop or notebook computer and prohibits the raising of the monitor display.

13. The security lock system for laptop and notebook computers according to claim 12, wherein said key means is a key guide formed on said enlarged head and an insertable key.

14. The security lock system for laptop and notebook computers according to claim 12, further comprising:

(a) a mounting guide for a cable formed in said rigid lock plate; and, (b) a cable with a first end affixed to said mounting guide and a looped second end, whereby said looped second end may be wrapped around a stationary object and then locked, thereby anchoring a computer to a stationary object with said cable.

15. The security lock system for laptop and notebook computers according to claim 12, further comprising carrying handle formed as part of, or affixed to said top or bottom face.

16. The security lock system for laptop and notebook computers according to claim 15, further comprising:

(a) a cable with loops at each end; and (b) a lock whereby one of said looped ends may be inserted through said caring handle and then wrapped around a stationary object and said lock may by locked through said looped ends, thereby anchoring the security lock and all attached objects.

17. The security lock system for laptop and notebook computers according to claim 9, further comprising an extended body plate affixed to, or formed as part of, said back wall and adapted to fit over a portion of a removable modular component access bay, whereby when said alarm module is affixed to a computer said access bay is blocked and a device such as a battery supply, hardrive, CD-ROM drive, or Zip drive is prevented from being removed.

18. The security lock system for laptop and notebook computers according to claim 12, further comprising an extended body plate affixed to, or formed as part of, said back wall and adapted to fit over a portion of an access door for a floppy disk, removable media, or CD drive, whereby when said alarm module is affixed to a computer said access door is blocked.

19. The security lock system for laptop and notebook computers according to claim 12, wherein said on/off switching a button switch extending from the rear wall of said hollow alarm module whereby insertion of said button switch, during mounting of said alarm module against said rigid "T" shaped plate causes the electrical current to be supplied to said battery powered alarm with motion sensing switch.

20. The security lock system for laptop and notebook computers according to claim 12, wherein said on/off switching-means is a mechanical lock cylinder and a key, whereby the action of said key rotated within said lock cylinder causes a switching arm to actuate a contact switch means whereby electrical current is supplied to said battery powered alarm with motion sensing switch.

21. The security lock system for laptop and notebook computers according to claim 12, wherein said contact switch means is selected from the group of electrical switches including push switches, single contact switches, click on/click off switches, optical switches, and pressure switches.

* * * * *